US005471796A

United States Patent [19]

Thompson

[11] Patent Number: 5,471,796

[45] Date of Patent: Dec. 5, 1995

[54] MULTI-PURPOSE LATHE

[76] Inventor: Gary F. Thompson, 9534 Atlantic Ave., South Gate, Calif. 90280

[21] Appl. No.: 897,834

[22] Filed: Jun. 12, 1992

[51] Int. Cl.[6] ..... B24B 29/08

[52] U.S. Cl. ..... 451/296; 451/307; 451/299; 451/397; 451/407; 269/289 MR; 269/909

[58] Field of Search ..... 51/137, 144, 145 R, 51/216 T, 236, 237 R, 238 S, 238.66, 135 R; 269/289 MR, 909

[56] References Cited

U.S. PATENT DOCUMENTS 1,393,046 10/1921 Singer ..... 51/238.66
2,756,547 7/1956 Rippl ..... 51/236
3,391,496 7/1968 Kurtz ..... 51/236
4,945,683 8/1990 Phillips ..... 51/145 R

*Primary Examiner*—Jack W. Lavinder
*Attorney, Agent, or Firm*—Ronald L. Juniper

[57] ABSTRACT

A multiple purpose lathe which can include a special valve polishing device, a camshaft lap device and other mechanisms. The valve polishing device includes a pair of generally axially parallel, rotatable rollers positioned to bear against and support a valve stem held therein while being polished by a movable belt. The camshaft lap device includes, optionally, a movable wheel bearing against the polishing belt which, in turn, bears against the camshaft being polished.

2 Claims, 8 Drawing Sheets

MULTI-PURPOSE LATHE

BACKGROUND OF THE INVENTION

Prior to this invention valve stem camshaft and the like grinding was often done in a drill press and sanding was done manually. This was clumsy, inaccurate and time wasteful.

Other devices had followers which didn't reliably follow in the same spot during polishing.

Other machines were often expensive and difficult to to operate.

Therefore, it is a purpose of this invention to solve these problems of the prior with a multi-purpose machine and holding device which polishes out burrs, nicks and other defects easily, quickly, accurately and with a cost-effective equipment means to accomplish the task effectively.

SUMMARY OF THE INVENTION

The multipurpose lathe in accordance with this invention includes a working-piece base for supporting the item to be polished which can be a valve stem, cam shaft or other items.

Associated with the base support is a polishing belt driven by suitable means which enable it to press against the object to be polished.

A movable arm structure provides rollers about which the polishing belt is rotated.

In some forms of the invention a pressing wheel is mounted on the movable arm so that it bears against the inside of the polishing belt causing the outside of the polishing belt to press tightly against the item being polished.

Adjustable holding devices,supported by the base, retain items to be polished by the polishing belt in position.

A special valve stem holding device can be attached to the base so as to position a valve stem for polishing by the polishing belt. This holding device includes a pair of valve stem bearing rollers which hold a valve stem to be polished so that it is properly aligned with the polishing belt.

DETAILED DESCRIPTION OF A PREFERRED FORM OF THE INVENTION

Figure 1:
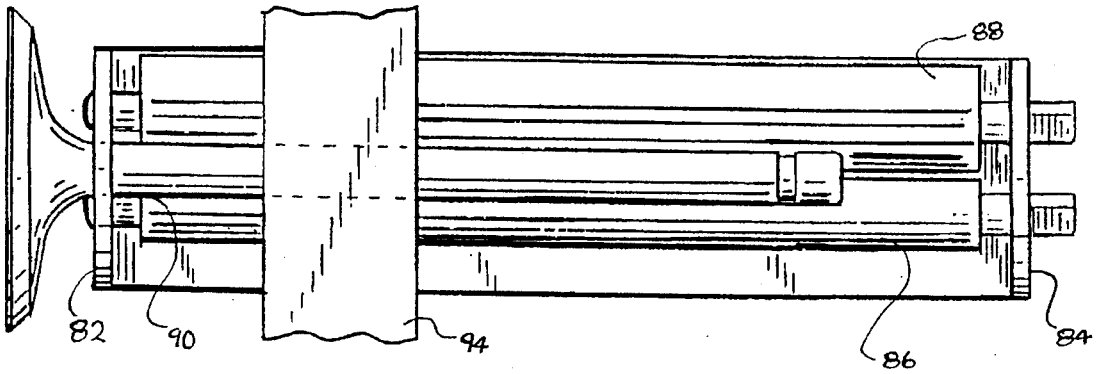
FIG. 1 is a top plan view, partly fragmented, of a special double-roller valve stem polishing holder,in accordance with this invention, having a valve stem held therein and a polishing belt shown contacting the valve stem.

As shown in the drawings the base support for this invention includes a pair of spaced front legs 20 and 22 and rear legs 24 and 26 held together near the bottom by plate 30. At the top, spaced frame bars 32 and 34 extend parallel to each other between shoulders 36 and 38, which are connecting portions between leg members 20 and 22, and 24 and 26, respectively.

Extending back and up from the shoulders 36 and 38 are bent elbow members 40 and 42 which carry a polishing unit supporting bar 44 between their upper ends 46 and 48, respectively Mounted on supporting bar 44 is the polishing unit which includes a main arm 50 that projects up and outwardly over the top of the lathe. Extending from the forward end of this arm 50 is a finger 52 on which a polishing belt roller 54 is supported.

A motor 56, having a driving wheel 58 extending axially therefrom, is mounted on supporting bar 44. Belt roller 54 and driving wheel 58 rotate in the same perpendicular plane with their longitudinal axes aligned parallel to each other so that a polishing belt 60 can be mounted thereon.

Extending down from near the end of main arm 50, (in some forms of this invention, as exemplified in FIG. 8) and inwardly of finger 52 is a middle finger 62, the end 64 of which provides rotatable support for a pressing wheel 66.

The pressing wheel 66, in turn, is so aligned by the location and length of finger 62 that it will rotate in the plane of belt roller 54 and driving pulley 58. It is specially positioned to press down against a mounted polishing belt 60 sufficiently to pull it tight. When doing so it causes the pressed portion of belt 60 to project down a polishing curve area.

The polishing unit can be moved laterally on supporting bar 44 and downwardly so that the portion of belt 60 caused to project down to form a polishing curve by wheel 66 can bear tightly against an item which is to be polished.

In order to hold an item to be polished special supporting assemblies have been created so that proper alignment and positioning of the operative units is facilitated.

Figure 2:
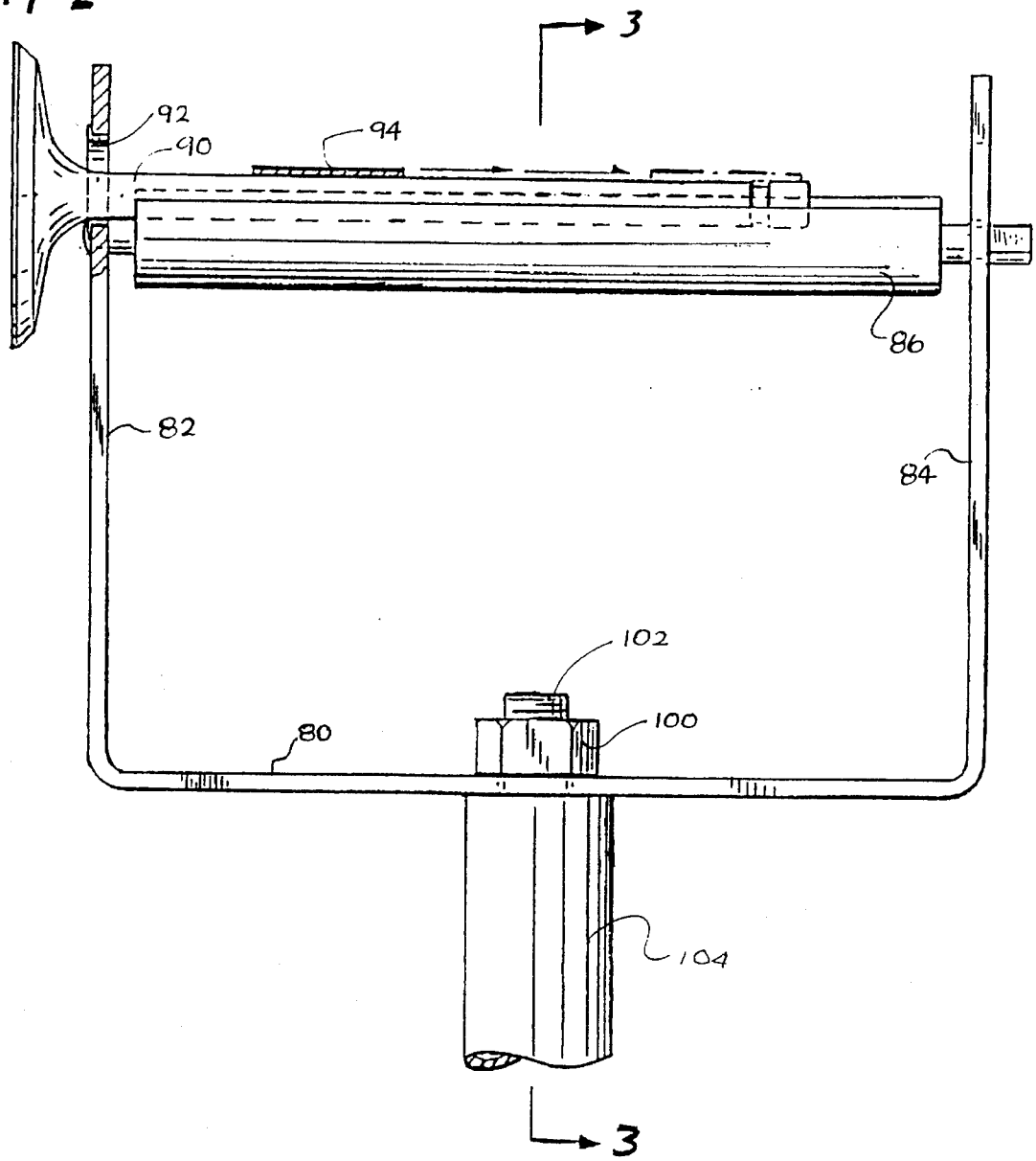
FIG. 2 is a side view of the valve stem polishing holder as shown in FIG. 1, showing, in ghost, how the polishing belt can be moved laterally on a valve stem held therein.
Figure 3:
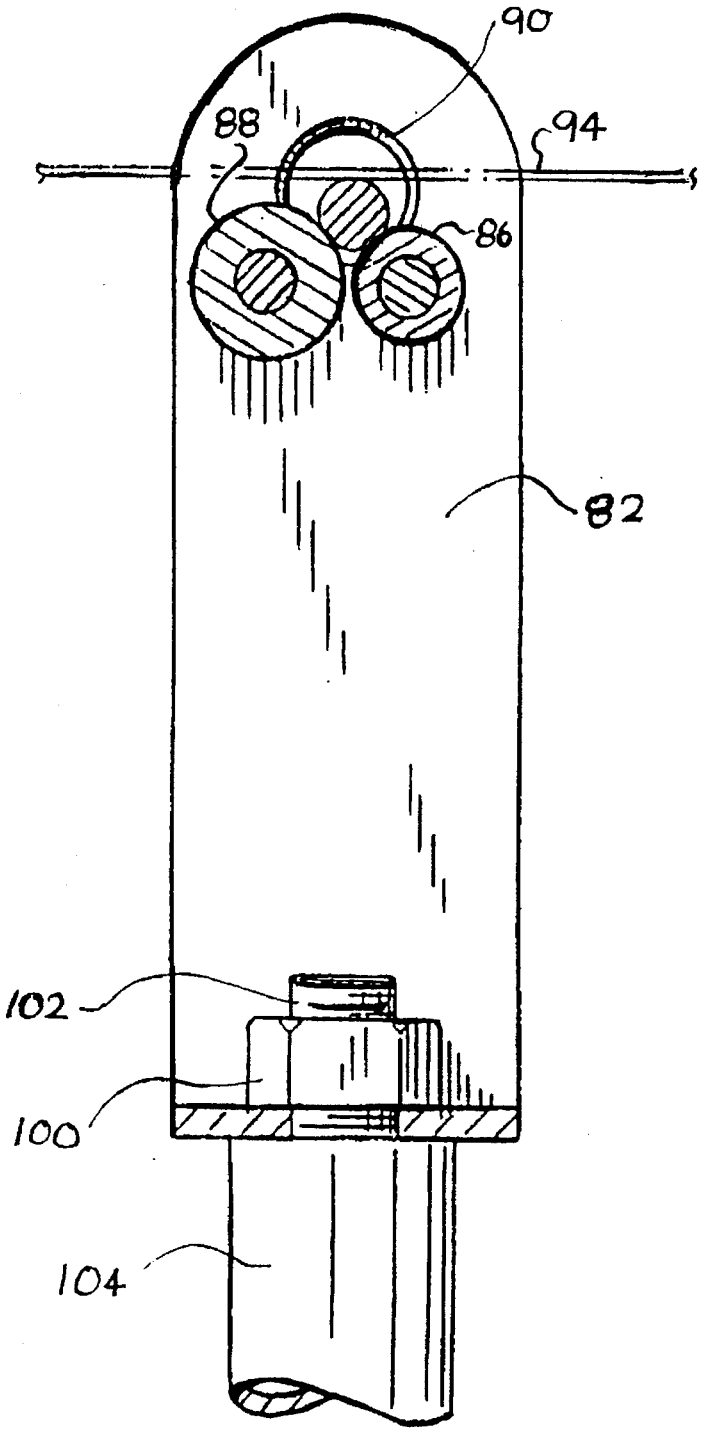
FIG. 3 is a cross-sectional end view of the valve stem polishing holder taken through the plane of 3—3 in FIG. 2.
Figure 4:
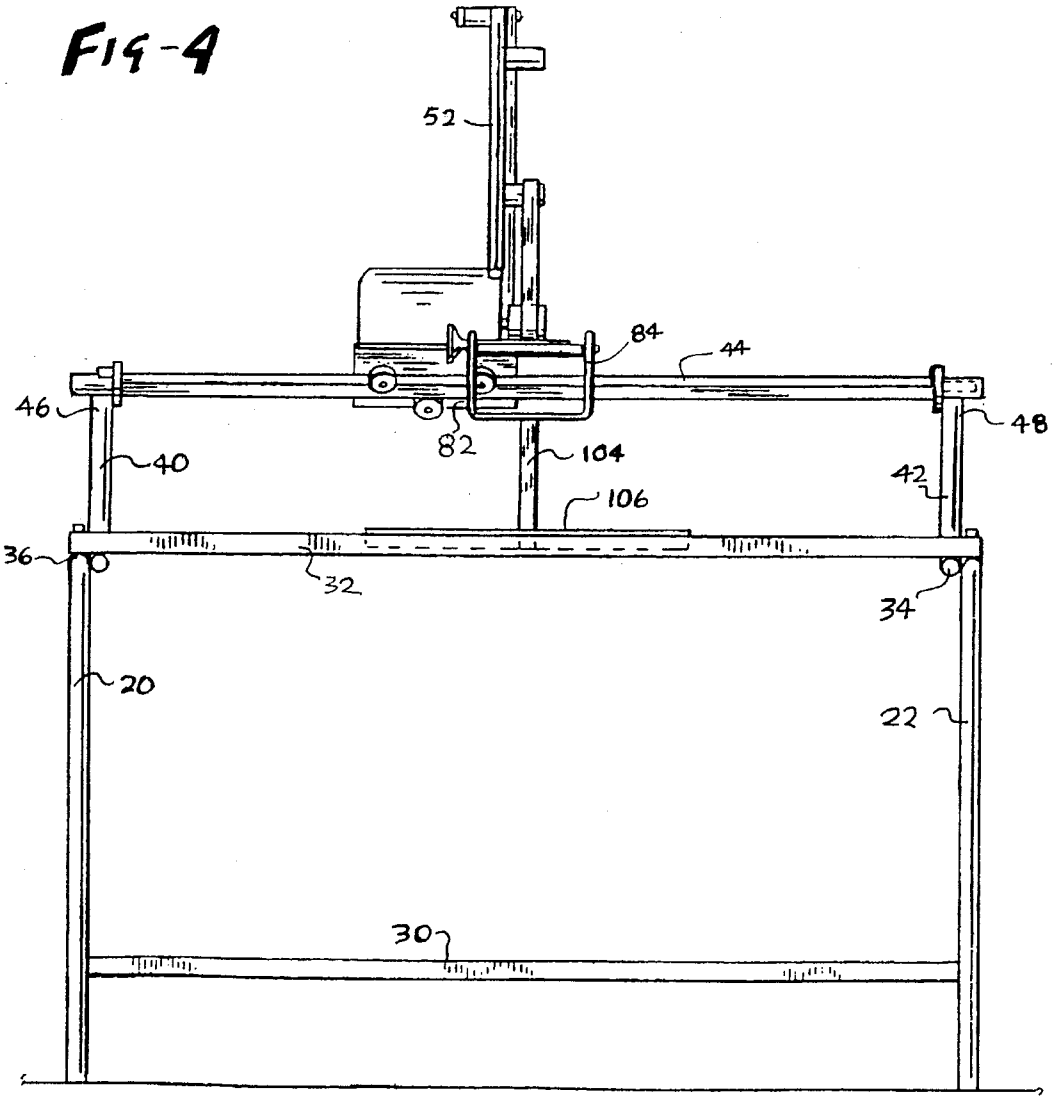
FIG. 4 is an overall end elevational view of a multi-purpose polishing lathe, in accordance with this invention, onto which a valve stem polishing holder, as previously shown, is mounted for operation.

Thus, as best shown in FIGS. 1, 2 and 3, a novel valve polishing support is provided for this invention which includes a U-shaped main assembly comprised of a lateral bottom base 80 formed with raised parallel support arms 82 and 84 extending upwardly from opposite ends of base 80.

Rotatably mounted through spaced bearing holes in the upper portions of support arms 82 and 84 are supporting rollers 86 and 88 spaced parallel axially and close enough to hold a valve stem 90 in the space between, but not touching, each other.

The valve stem that is to be polished is mounted through a guide hole 92 formed in support arm 82 above the bearing support holes in which rollers 86 and 88 are mounted. The guide hole 92 has a bottom surface low enough that a valve stem held therein will bear against and nest on the adjacent top surfaces of rollers 86 and 88.

The rollers 86 and 88 are of predetermined different diameters so that, as a polishing belt 94 bears down on a valve stem 90 held therein, it moves in a direction, relative to the valve stem 90, that places the larger roller 88 to the rear. The rollers, thus rotatably brace the valve stem as it is being polished so as to precisely hold it in aligned position.

The valve stem polishing support unit is mounted by means of a nut 100 threaded securely to a bolt end 102 of a vertical support post 104 which extends through a mating hole in base 80.

The support post 104, in turn, is mounted on its bottom end to plate 106 which, in turn, is supported, on its opposite edges 108 and 110, on top of frame bars 32 and 34, respectively.

Figure 7:
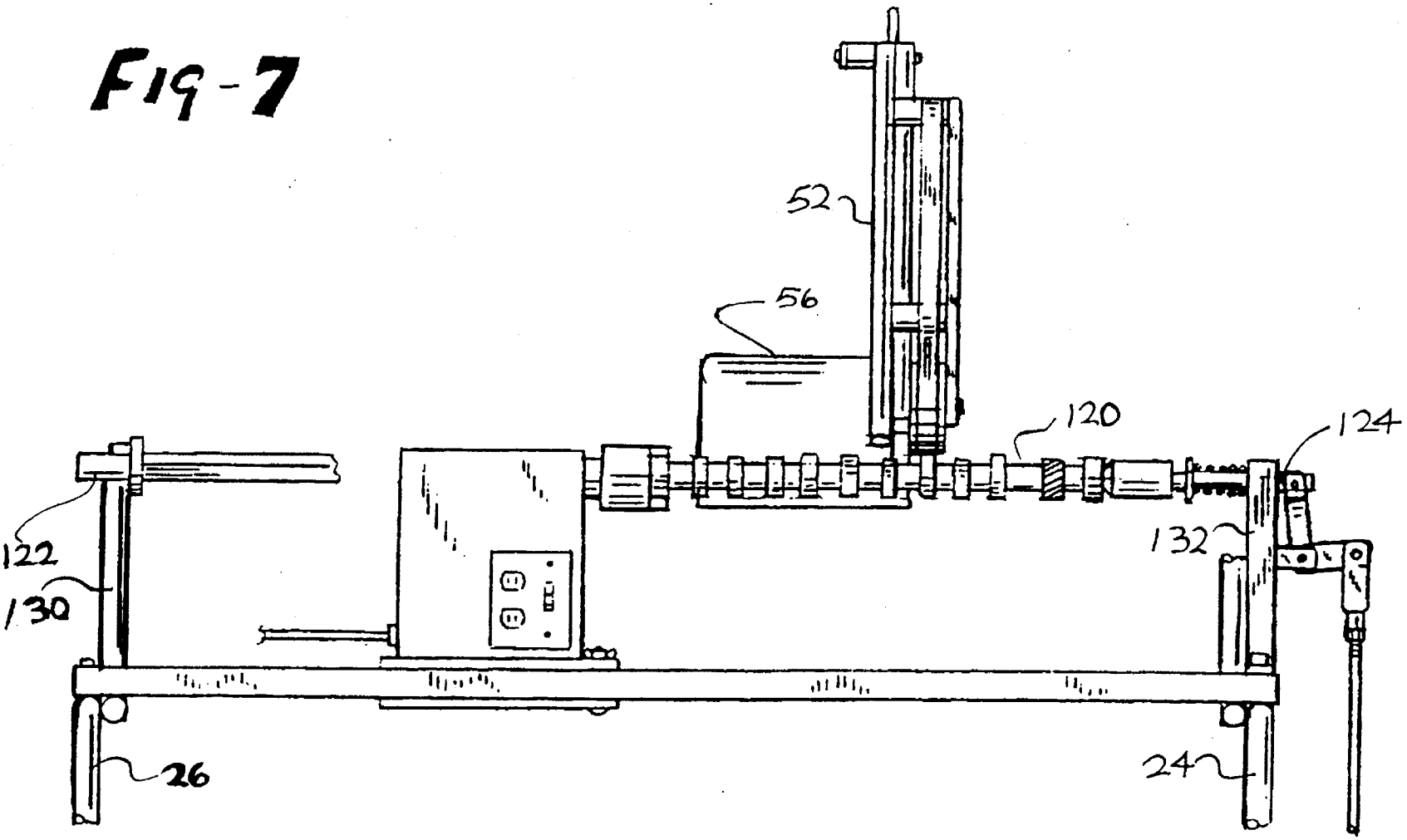
FIG. 7 is a fragmented elevational view of a lathe in accordance with this invention showing a camshaft held therein by a modified holding structure from that previously shown and a polishing belt engaging said camshaft.
Figure 8:
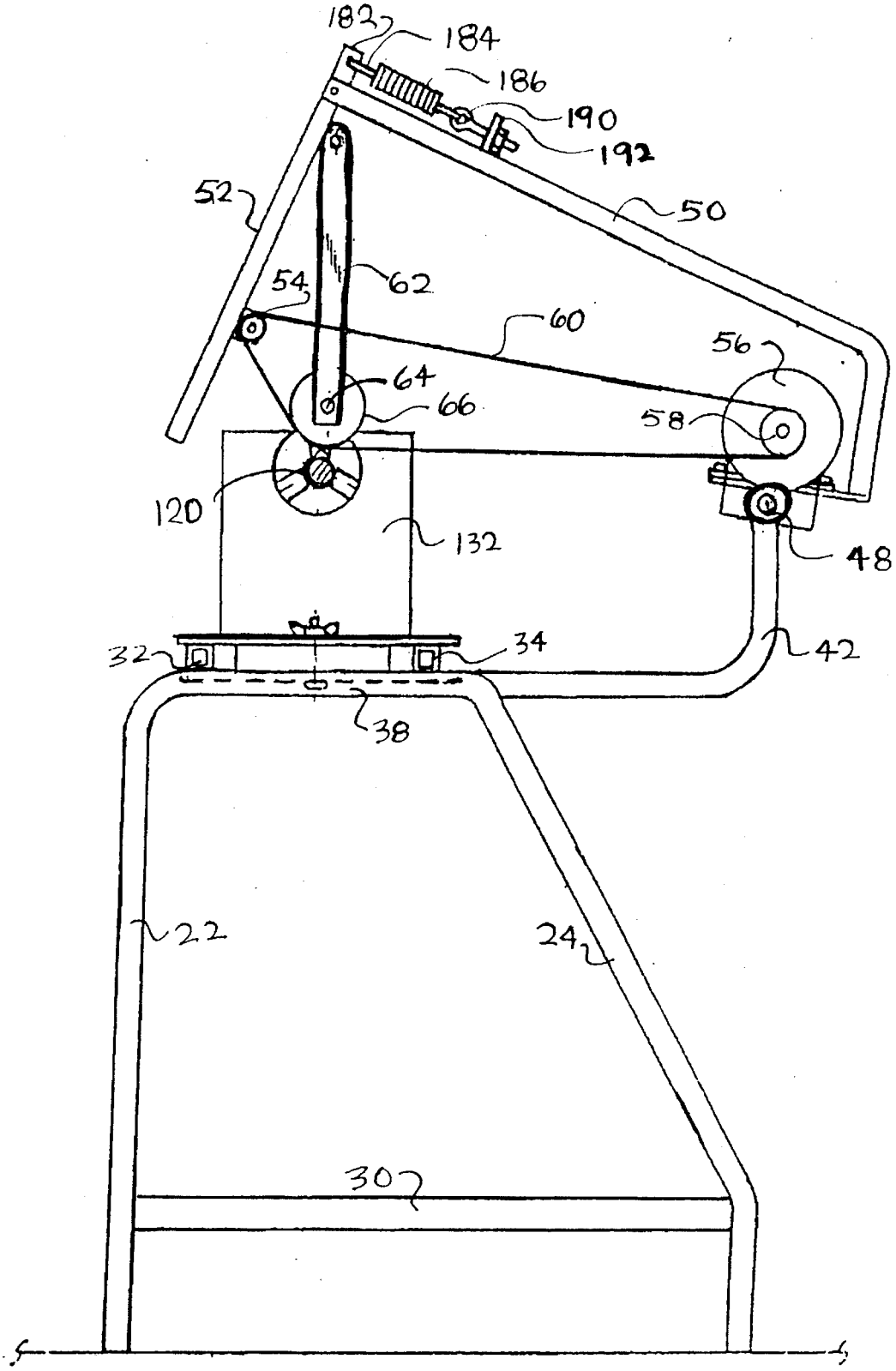
FIG. 8 is a side view of a lathe as in FIG. 7 showing a wheel pressing against a cam-shaft held therein.

If a cam-shaft 120, as shown in FIGS. 7 and 8, is to be polished its opposing ends are supported within mating, axially aligned, bearing openings 122 and 124, cut into perpendicularly rising, shaft supporting, plates 130 and 132 spaced sufficiently enough apart to hold cam-shaft 120.

The shaft supporting plates 130 and 132 are mounted between spaced frame bars 32 and 34 in position so that a polishing belt 60, as shown, can be moved to bear against and selectively polish the camshaft in a precisely controlled manner.

Figure 5:
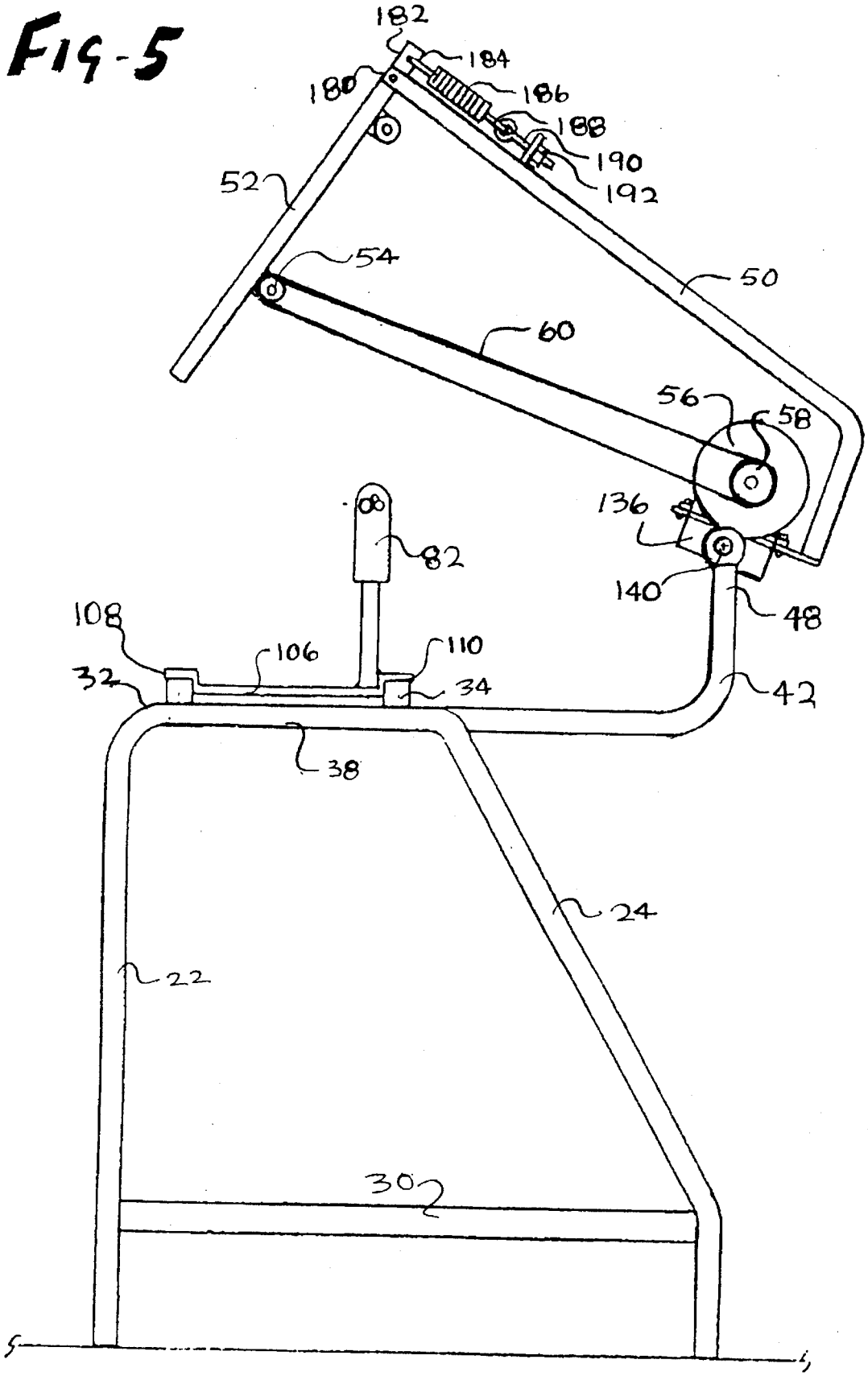
FIG. 5 is a side elevational view of a lathe as shown in FIG. 4 with a polishing belt mounted above the valve stem polishing holder.
Figure 6:
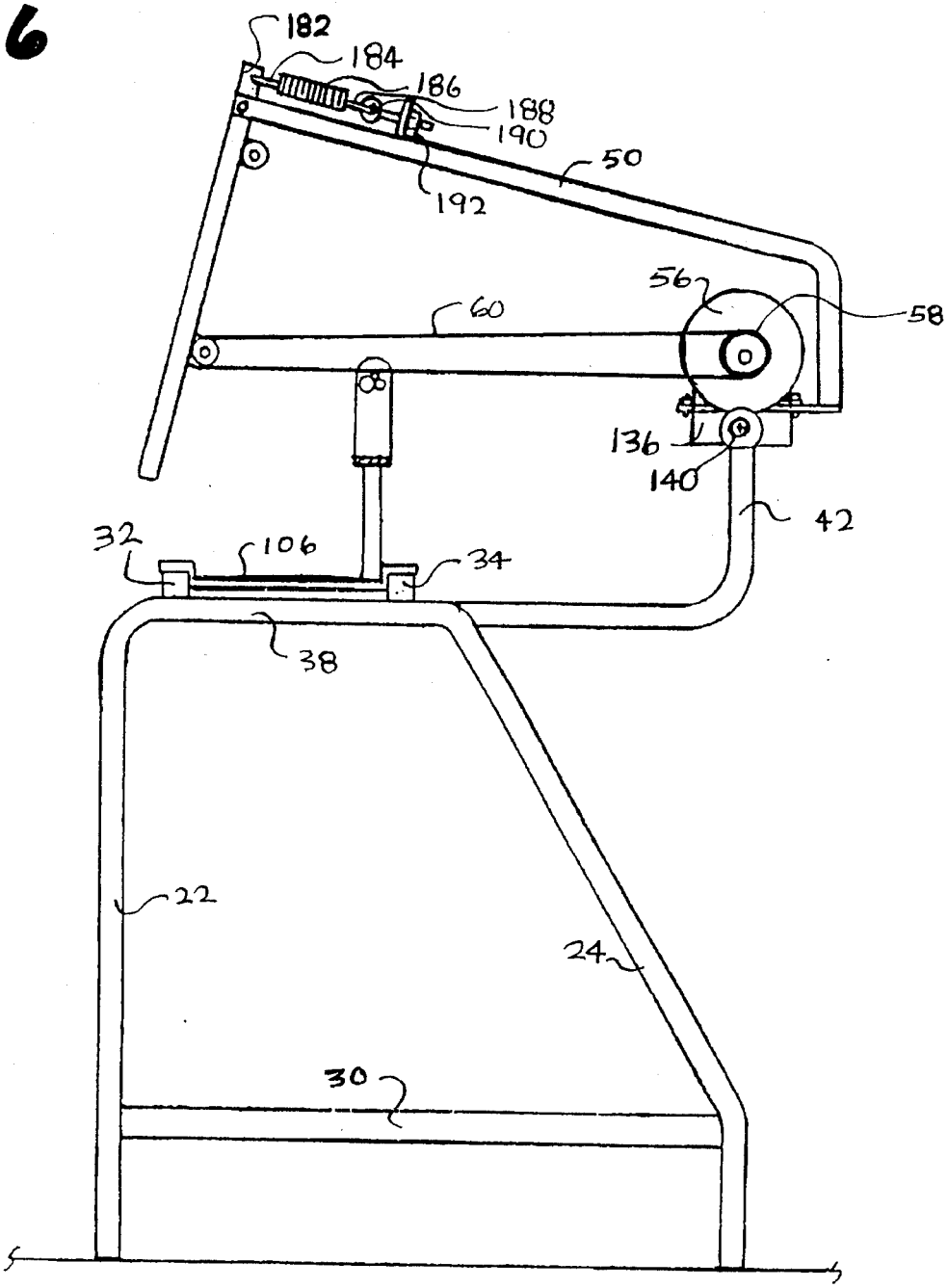
FIG. 6 is a lathe as shown in FIG. 5 with the polishing belt moved to engage a valve stem in the polishing holder.

As shown in FIGS. 5 and 6 the motor 56 is supported on a motor mount 136 which is connected to supporting structure carrying the polishing belt 60. This supporting structure is pivotally movable around an axle 140 attached between the upper ends of bent elbow members 40 and 42.

The coordinated structures holding the polishing belt 60 are so aligned that the outer flat surface of the polishing belt 60 will be precisely aligned with axis of a valve stem camshaft or other item to be polished when the belt 60 is pivoted down against it as shown in FIG. 6.

Figure 9:
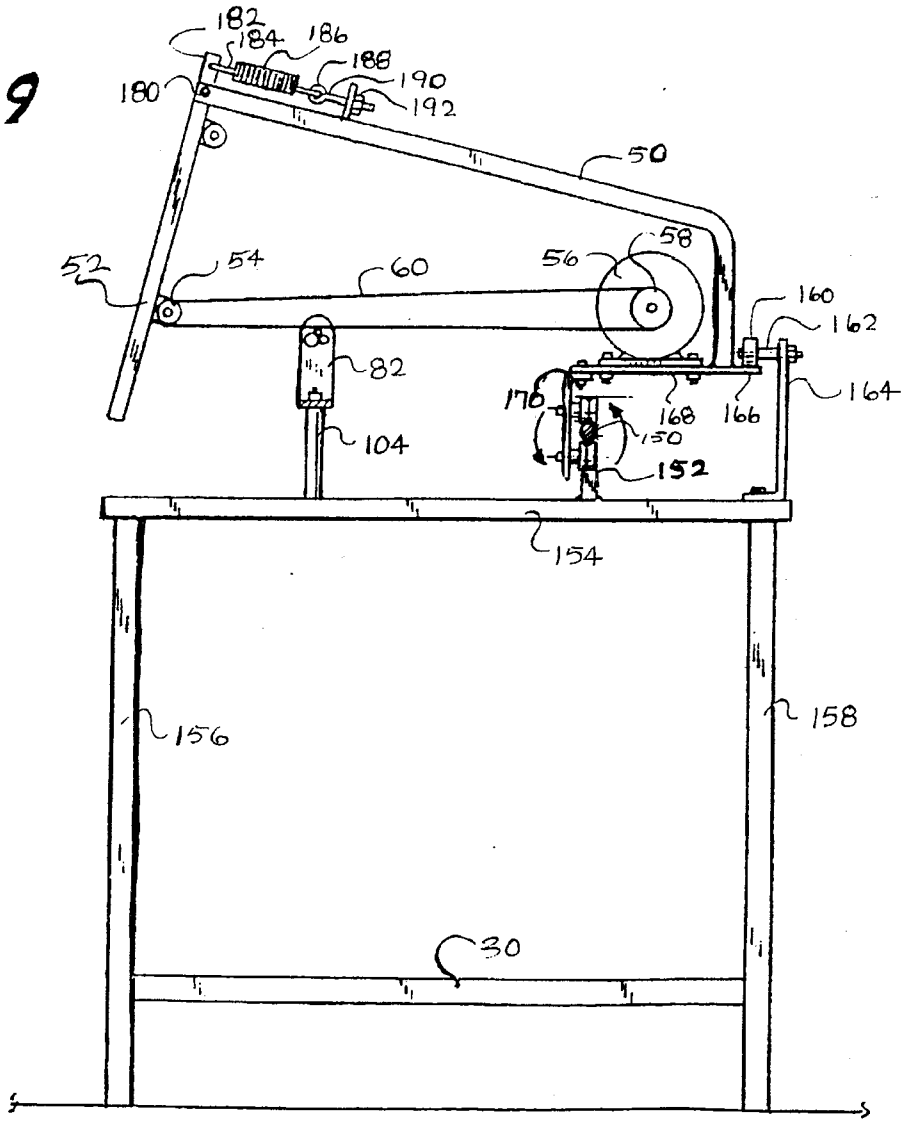
FIG. 9 is a side view of a lathe in accordance with this invention showing the valve polishing support and a different embodiment of the turning mechanism for the polishing belt holder.

Another form of pivoting mechanism for the polishing belt support structure is shown in FIG. 9 where a pivoting axle 150 is mounted in a bracket 152 extending up from a horizontal base 154 supported by vertically spaced legs 156 and 158.

In this form, a roller 160, with an axle 162 extending out from the upper portion of a roller bracket 164, is mounted on an end of base 154, extending outwardly from and nearest the pivoting axle 150. Axle 150,in turn, bears against an outwardly extending lip 166 of a motor mount 168, the opposite end of which is connected to a pivot mount 170 engaged with pivoting axle 150.

In order to adjust the tension on the endless polishing belt 60, mounted on rollers 54 and 58, the finger 52 carrying roller 54, is mounted for hinged movement on pivot 180, connected to the forward end of main arm 50. An extended upper end 182 of finger 52 is connected to a forward hooked end 184 of spring 186 which, in turn, extends back aligned with main arm 50 and is connected at its opposite end 188 to an adjustable turnbuckle 190 connected to spring bracket 192 mounted on top of main arm 50.

Though a preferred embodiment of this invention has been shown and described herein this is not meant as a limitation of this invention but exemplicative only as an illustration of how it might be used and made wherein the scope of forms intended to be covered are defined by the spirit of the following claims.

What is claimed is:

1. A multi-purpose polishing lathe including a base supporting means which includes a bracket stand provided with a mounting base from which a pair of spaced supporting arms extend upwardly therefrom:

rotating motor means;

means for predeterminedly holding an item to be polished securely on said base supporting means;

endless sanding belt polishing means mounted on spaced rollers, one of which is driven by said motor means, said sanding belt attached to said base supporting means, and moveable to bear against an item to be polished so as to precisely polish an item held on said base supporting means;

a pair of first and second substantially axially parallel cylindrical rollers mounted for rotation close enough to each other to hold a valve stem on top of and between said rollers, without said rollers touching each other, said rollers supported by and between said upwardly extending supporting arms, wherein said first and second rollers have different diameters and the larger of said rollers is to the rear of the smaller one relative to a direction of said sanding belt when it is moved to bear against and polish an item held in said supporting means.

2. A valve support device for holding a valve stem while the stem is being polished including a bracket stand provided with a mounting base from which a pair of spaced supporting arms extend upwardly therefrom, a pair of first and second substantially axially parallel cylindrical rollers mounted for rotation close enough to each other to hold a valve stem on top of and between the rollers without the rollers touching each other, wherein the diameter of the first roller is different than the diameter of the second roller, said rollers supported by and between said upwardly extending supporting arms, said mounting base adapted to be positioned relative to a polishing means which can bear against and polish said valve stem held by said rollers therein, and wherein the larger of said rollers is to the rear of the smaller roller relative to the direction of movement of the polishing means that may be used to polish said valve stem held in said rollers.

* * * * *